US005823688A

United States Patent [19]

Mizukami et al.

[11] Patent Number: 5,823,688

[45] Date of Patent: Oct. 20, 1998

[54] PRINTER INCLUDING IMPROVED PRINT HEAD CONTROL

[75] Inventors: Tokio Mizukami, Ayase; Hiroshi Fujikura, Yokohama, both of Japan

[73] Assignee: International Mfg. and Engineering Services Co., Kana-Gawa-ken, Japan

[21] Appl. No.: 840,037

[22] Filed: Apr. 24, 1997

[30] Foreign Application Priority Data

Apr. 25, 1996 [JP] Japan ..... 8-105760

[51] Int. Cl.[6] ..... B41J 3/28

[52] U.S. Cl. ..... 400/27; 400/24; 400/56; 400/59

[58] Field of Search ..... 400/24, 25, 26, 400/27, 55, 56, 57, 58, 59, 605

[56] References Cited

U.S. PATENT DOCUMENTS

| | | | |
|---|---|---|---|
| 4,797,017 | 1/1989 | Okouchi | 400/57 |
| 4,812,059 | 3/1989 | Masaki | 400/59 |
| 5,156,465 | 10/1992 | Kakiuchi | 400/24 |
| 5,227,809 | 7/1993 | Carpenter et al. | 400/56 |

FOREIGN PATENT DOCUMENTS

| | | | |
|---|---|---|---|
| 57-150592 | 9/1982 | Japan | 400/27 |
| 64-1567 | 1/1989 | Japan | 400/24 |
| 3-21477 | 1/1991 | Japan | 400/24 |
| 3-193375 | 8/1991 | Japan | 400/27 |
| 4-1072 | 1/1992 | Japan | 400/27 |
| 4-163075 | 6/1992 | Japan | 400/24 |

*Primary Examiner*—Christopher A. Bennett
*Attorney, Agent, or Firm*—E. C. Hancock; Holland & Hart llp

[57] ABSTRACT

A plurality of lines are printed by the print head of a printer which is moved in a predetermined print direction on a sheet placed on a planar supporting surface wherein the sheet is fed perpendicular to the print direction. The print head is slidably mounted on a guide bar which is supported by a frame parallel to the sheet supporting surface so as to permit moving the lower end of the print head upwardly and downwardly relative to the support surface. The frame is biased in the downward direction normally. During non-print operation, a driving lever moves the frame upwardly to raise the print head to an initial position spaced above the support surface by a predetermined distance where it is maintained. During a print operation, the driving lever engages the frame to drive it upwardly or downwardly with the upward movement against the bias force. When the driving lever engages the frame for moving it downwardly, the driving lever engages to suppress a rapid downward movement of the frame due to the bias force thereby slowly moving the frame downwardly. The driving lever disengages from the frame after the print head lower end lands on the sheet placed on the support surface. Clearance between the lever and frame is detected. A control device responds to a print start signal for activating a driving source to apply the driving lever with a downward driving force for moving the frame downward. The control device responds to the detection signal to deactivate the driving source to terminate the application of downward force to the frame and hold the lever at its stopped position. The control device responds to completion of a print operation of one line on the sheet to activate the driving source for moving the driving lever from its stopped position to engage the frame and move it upwardly.

10 Claims, 6 Drawing Sheets

PRINTER INCLUDING IMPROVED PRINT HEAD CONTROL

BACKGROUND OF THE INVENTION

1. Field of the Invention

The present invention relates to printers capable of printing characters on the pages exposed in an opened book, such as a diary, notebook, passbook, passport, loose leaf books, etc. The present invention relates to apparatus and methods for printing on a book which typically has a bound portion by which a plurality of sheets are typically bound.

More particularly, the present invention relates to a printer which prints characters on opened pages of a book, such as diary, notebook, passbook, passport, etc. The book has a bound portion by which a plurality of sheets are bound. The opened book is supported on a support surface and fed in a direction along the bound portion, and the printing of the characters on the pages of both sides of the bound portion is performed in a perpendicular direction to the feed direction.

2. Description of the Related Art

A passbook printer has been used which prints the passbook including sheets or pages bound at their edge by feeding the passbook in the direction along the bound portion. In the opened condition, a thickness of the left side pages of the passbook usually differs from a thickness of the right side pages although the thickness of both sides are substantially equal when the passbook is opened at a middle page. The terms "left and right pages" used in the present invention means the left side portion and the right side portion of the bound portion of the opened passbook. The thickness of the left side pages, for example, means a total thickness or height of the left side which is determined by the number of stacked sheets of the left side and the left side passbook cover, if any.

A problem encountered when developing the printer in which a lower end of a print head must land on an uppermost page of the pages relates to the fact that the height of the stack is variable depending upon the page to which the book is opened. After printing one line, it is necessary to raise the lower end of the print head from the surface of the page by a mechanical means to produce a clearance between the lower end of the print head and the surface of the page to accommodate feeding of the book by a line. In the printer in which the opened book is supported on a planar supporting surface and both the left and right side pages of the bound portion are printed, the lower end of the print head is raised at an initial position in the initial state, which is spaced from the surface of the supporting surface by a distance larger than an expected thickness of the book, and the lower end of the print head is moved downwardly from the initial position to the book when each line is printed.

The inventors of the present invention had tried to use a driving lever on which a supporting frame of the print head rides. The driving lever is moved upwardly to raise the supporting frame thereon to produce the above clearance required for feeding the book after the print operation of one line. The driving lever supports the weight of the supporting frame and the print head. To produce the downward movement of the print head, this driving lever is moved downwardly to softly land the print head on the page by suppressing an excess downward movement of the print head. The driving lever is continuously moved downwardly after the print head has landed on the page. Since the distance between the top page of the pages and supporting surface is not known (in other words, the height of the top page on which the print head is landed is not known), the lowermost end of the stroke of the driving lever is set at the level of the supporting surface.

However, the inventors of the present invention have found the following problem in this case. For simplifying the description, it is assumed that the distance between the initial position and the supporting surface is 20 mm, and a height of the page from the supporting surface is 10 mm. The driving lever is lowered to the level of the supporting surface during the print operation. To raise the print head to the initial position after printing one line of the page, the driving lever is started from the level of the supporting surface and after moving by the distance 10 mm, the driving lever engages or supports the supporting frame of the print head to raise the supporting frame and the print head to the initial position of 20 mm.

The speed of the driving lever when it engages the supporting frame of the print head should be selected at a relatively low speed to prevent the print head from jumping up. Accordingly, the inventors of the present invention found that the movement of the driving lever between the level of the supporting surface and the height of the page which was repeated for each line feed was an unnecessary movement, so that the speed of the print operation was decreased.

As described above, in the printer in which the opened book is supported on a planar supporting surface and both the left and right side pages of the bound portion are printed, the lower end of the print head is raised at the initial upper position in the initial state, which is spaced from the surface of the supporting surface by a distance larger than an expected thickness of a book, and the print head is moved downwardly from the initial position to the book for each line printing. In the prior art printer, when all lines (i.e., the first line to the last line) of the left side page are printed, for example, the print head which was maintained at the height of the initial position is moved above the first print position of the first line of the left page, and the print head is moved downwardly to the first line to print that line.

After printing the first line, the print head is moved upwardly to the initial position, the book is fed by one line, and the print head is moved above the first print position of the second line while keeping the height of the initial position. The print head is moved downwardly from the height of the initial position to the first print position of the second line. That is, when the first line of the left side page and the first line of the right side page are to be printed, the prior printer moves the print head to the first print position of the first line of the left side page while keeping the height of the initial position, and moves the print head downwardly to the first line to print that first line.

After printing the first line on the left side page, the print head is again moved upwardly to the initial position, after which it is moved to the first print position of the first line of the right side page again while keeping the height of the initial position. The print head is moved down to the first line to print the first line of the right side page. Again, the print head is raised to the height of the initial position, and the book moved by one line. The print head is moved above the first print position of the second line of the left side page while keeping the height of the initial position, and is moved down to the second line of the left side page to print the second line. After printing of the second line, the print head is raised to the height of the initial position and is moved above the first print position of the second line of the right side page, where it is moved down to the second line to print that line.

SUMMARY OF THE INVENTION

The problem solved by the invention relates to the loss of printing speed for a printer in order to accommodate movement of the print head. As stated above, for each line feed, the driving lever is moved upwardly from the level of the supporting surface to the height of the page. After this travel, the driving lever engages with the supporting frame of the print head for raising the print head from the surface of the page to perform the line feed of the book. This movement of the driving lever between the level of the supporting surface and the level of the top page involved excessive movement, and decreased the printing speed of the printer.

Further, the distance between the initial position and the supporting surface is larger than the expected thickness of the book. For each print operation of a new line, the prior printer repeatedly moves the print head from the initial position to the surface of the page, and moves the print head upwardly from the page to the initial position, so that the distance of the movement of the print head in the perpendicular direction to the surface of the page was remarkably increased, whereby the print speed of the printer was decreased.

The aforementioned problem is solved by printers in accordance with the present invention. The printer of the present invention employs a print head that is moved relative to a sheet placed on a planar supporting surface in a predetermined print direction. This sheet is fed in a perpendicular direction to said print direction to print a plurality of lines. A printer in accordance with this invention includes a guide bar slidably mounting the print head, and a supporting frame for supporting this guide bar in parallel to the supporting surface and print direction. This supporting frame moves the guide bar upwardly or downwardly to position a lower end of said print head relative to the supporting surface. The supporting frame is downwardly biased by a bias force.

A driving lever, during non-print operation, is driven for moving the supporting frame upwardly to raise the lower end of the print head to an initial position located above the supporting surface, which position is spaced from the supporting surface by a predetermined distance. The lower end of the print head is maintained at this initial position. The driving lever, during a print operation, is driven for movement upwardly or downwardly with respect to the supporting frame. When the driving lever is driven in the direction for moving the supporting frame upwardly, the driving lever engages with the supporting frame to move it upwardly against the bias force. When the driving lever is driven in the direction for moving the supporting frame downwardly, the driving lever engages with the supporting frame to suppress a rapid downward movement thereof due to the bias force to slowly move downwardly the supporting frame.

The driving lever continuously moves downwardly during the time a driving force is applied to the driving lever, and disengages from the supporting frame after the lower end of the print head lands on a sheet placed on the supporting surface. A driving source applies the driving force to the driving lever. A detecting device detects an occurrence of a clearance between the driving lever and the supporting frame which may have occurred by disengagement of the driving lever from the supporting frame during the continuous movement of the driving lever.

A control device responds to a print start signal for activating the driving source to apply a downward driving force driving lever with downward driving force for moving the supporting frame downwardly. The control device responds to a detecting signal indicating occurrence of clearance generated by the detecting device to deactivate the driving source terminating the application of the downward driving force to the supporting frame to hold the driving lever at its stopped position. The control device responds to a completion of a print operation of one line on the sheet to activate the driving source to apply the driving lever with upward driving force for moving the driving lever upwardly from the stopped position to engage with the supporting frame to move the supporting frame upwardly.

The printer further comprises; a position detecting means for detecting an arrival of the lower end of the print head at a standby position above the supporting surface for generating a position detecting signal. This standby position is spaced from the supporting surface by a predetermined distance, lower than the aforesaid initial position, and characterized in that the control device responds to the position detecting signal to deactivate the driving source to terminate the application of the upward driving force to the supporting frame, and controls to move the lower end of the print head downwardly from the standby position for printing succeeding lines on the sheet.

The driving source can include a DC motor and a converting means for converting rotation in one direction generated by this DC motor into the aforesaid upward driving force and converting rotation in the other direction generated by said DC motor into said downward driving force. The position detecting means can include means for establishing a second driving period of said DC motor which is shorter than a first driving period of said DC motor during which said lower end of said print head is moved from the initial position to the surface of the sheet.

A timer means generates said position detecting signal at a lapse of the second driving period after the DC motor has started said rotation in one direction from its rotational position causing the lower end of the print head to land on the sheet. The driving source can include a stepper motor and a converting means for converting rotation in one direction generated by the stepper motor into said upward driving force and converting rotation in the other direction generated by said stepper motor into said downward driving force. The position detecting means includes means for establishing a second number of steps of the stepper motor which is smaller than a first number of steps of said stepper motor during which time the lower end of the print head is moved from said initial position to the surface of the sheet.

A position detecting signal is generated when the stepper motor has rotated by said second number of steps from its rotational position causing the lower end of the print head to land on the sheet. The supporting frame includes a first member extending in parallel to the print direction, a second member extending from one end of said first member in a perpendicular direction to the print direction, and a third member extending from the other end of said first member in a perpendicular direction to the print direction. The second and third members are pivoted on a frame of the printer. Both the ends of the guide bar are fixed on said second member and said third member.

An extended member is provided to extend from said first member in a perpendicular direction to the print direction. One end of the driving lever is pivoted on the frame for pivoting in a perpendicular direction to the print direction, and the other end of the driving lever is engaged with said extended member. The detecting device can employ a light emitting diode and a photodetector mounted on the driving lever to generate said detecting signal indicating occurrence of a clearance by disengagement of the driving lever from the supporting frame when an interruption of the light from said light emitting diode by said extended member is terminated.

The printer of the present invention is for printing on a book including a plurality of stacked sheets bound at a bound portion or binding. The book is opened, supported on a supporting surface and fed in a feed direction parallel to the book binding or bound portion. A left side page and a right side page of this book are printed in a perpendicular direction to the feed direction. A moving means moves a lower end of a print head in a first direction from an initial position which is spaced from the supporting surface by a predetermined distance, or in a second direction from that supporting surface to the initial position.

A control means to control the moving means includes means for moving the lower end of the print head in a first direction from the initial position to one of the left and right side pages to measure a first distance between the initial position and that one page. The lower end of the print head is moved in a first direction from the initial position to the other page of the aforesaid left or right side page to measure a second distance between the initial position and the other page. The first distance is compared with said second distance to identify the page which generates the lesser distance to establish a standby position above the page. This standby position is lower than the initial position and is characterized in that the control device responds to the establishment of this standby position to move the lower end of the print head downwardly during printing of a succeeding line.

The printer of the present invention is intended for printing on an opened book which includes a plurality of stacked sheets bound at a bound portion or binding. The opened book is supported on a supporting surface and fed in a feed direction parallel to the length of the bound portion. A left side page and a right side page of this book are printed in a print direction which is perpendicular to the aforesaid feed direction. The printer employs a first means for moving a lower end of a print head in a first direction from an initial position which is spaced from the supporting surface by a predetermined distance, or in a second direction from the supporting surface to the initial position. A second means moves the print head in said print direction. A third means causes the print head to print a line while a fourth means measures the distance of movement of the lower end of the print head in a first direction from the initial position to the page.

A control means controls the first, second, third and fourth means for performing steps. These steps include (a) moving the lower end of the print head while keeping it at the height of the initial position along the print direction to a position which is located above first print position of a first line of one page on the left side and the right side page of the book; (b) moving the lower end of the print head in said first direction from the initial position to measure a first distance between the initial position and the aforesaid one page; (c) printing a first line of said one page by moving the lower end of the print head in the print direction while contacting the lower end of the print head on said one page; (d) moving the lower end of the print head in a second direction to the initial position after the completion of print of the first line; (e) moving the lower end of the print head while keeping a height of the initial position along the print direction to a position which is located above the first print position of first line of the other page of said left and right side pages of the book; (f) moving the lower end of the print head in the first direction from the initial position to measure a second distance between the initial position and said other page; (g) printing the first line of the other page by moving the lower end of the print head in said print direction while contacting the lower end of the print head on said other page; (h) comparing the first distance with the second distance to identify the page which generates the lesser distance to establish a standby position above the page, which is lower than said initial position, which generates the lesser distance, to move the lower end of the print head in the aforesaid second direction from said other page to the standby position, and to feed the book in a line feed direction; (i) moving the lower end of the print head while keeping at a height of the standby position along the print direction to a position which is located above the first print position of a second line of said one page; (j) moving the lower end of the print head in the first direction from the standby position to said one page; (k) printing the second line of said one page by moving the lower end of the print head in said print direction so as to contact said lower end of the print head on said one page; (l) moving the lower end of the print head in said second direction to the standby position after the completion of print of the second line; (m) moving the print head lower end while keeping it at a height of the standby position along the print direction to a position which is located above first print position of second line of the other page, (n) moving the print head lower end in the first direction from the standby position to said other page, (o) printing the second line of said other page by moving the print head lower end in the print direction with contacting the lower end of the print head on said other page.

Those having normal skill in the art will recognize the foregoing and other objects, features, advantages and applications of the present invention from the following more detailed description of the preferred embodiments as illustrated in the accompanying drawings.

DETAILED DESCRIPTION OF THE PREFERRED EMBODIMENTS

Figure 1:
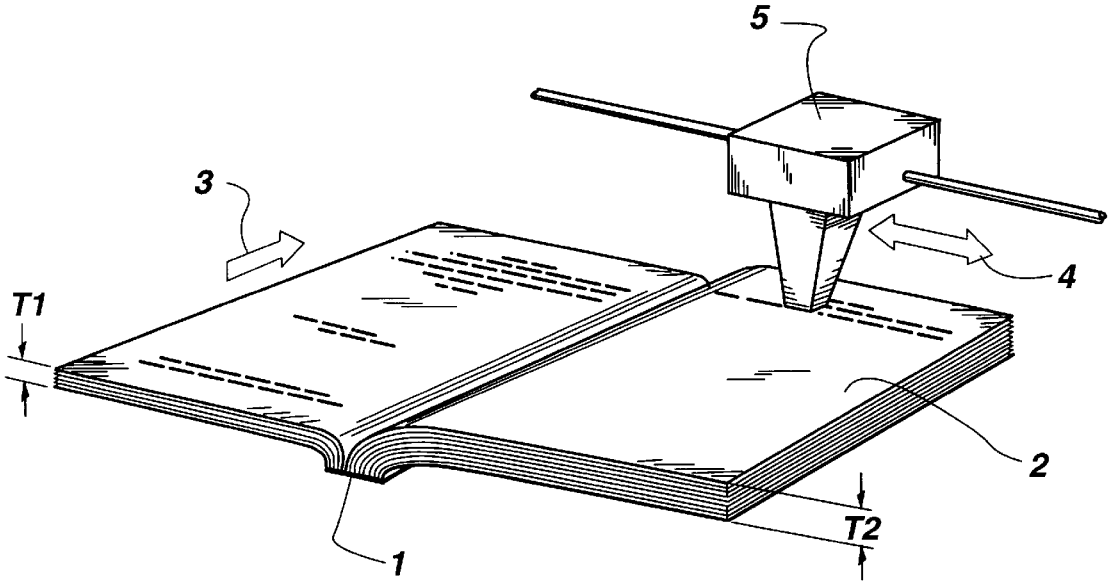
FIG. 1 shows the feeding direction and the printing direction of book 2.

FIG. 1 shows the printing scheme performed by the printer of the present invention in which the book 2 formed by bounding a plurality of sheets at a binding or bound portion 1 along one edge is opened on a planar supporting surface, and the left and right side pages are printed. The height of the left side pages and the right side pages are represented by T1 and T2, respectively. Arrow 3 represents the direction of the line feed, and arrow 4 represents the moving direction of print head 5 or the print direction.

Figure 2:
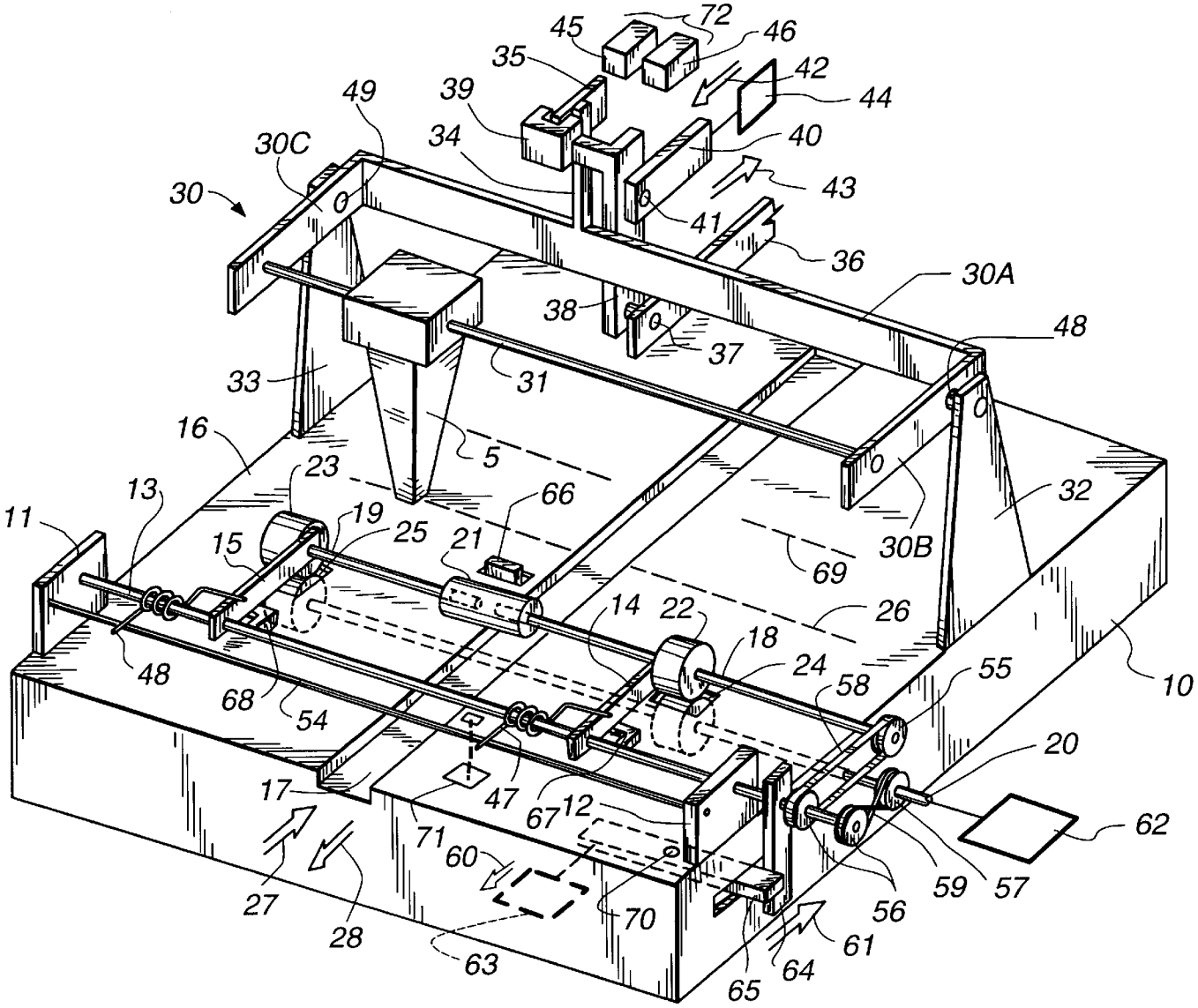
FIG. 2 shows the structure of the printer of the present invention.

FIG. 2 shows the printer in accordance with the present invention in somewhat greater detail. An opened book 2 is supported on planar supporting surface 16, and a channel 17 is provided at the center of the supporting surface 16. The bound portion of the book 2, such as a diary, passbook, or the like, is loosely positioned within channel 17, and book 2 is placed on supporting surface 16 where it is fed in the direction of arrow 27. After the print operation is completed, the book 2 is ejected in the direction of arrow 28. Two supporting members 11 and 12 are mounted on supporting surface 16. A pivoting shaft 13 is pivotally mounted on supporting members 11 and 12 above the supporting surface 16 so that pivoting shaft 13 is parallel to supporting surface 16, and perpendicular to the direction of the channel 17.

(A) Description of the Printing Operation of the Printer

As seen in FIG. 2, the print operation of the printer in accordance with the present invention is described. The pivoting shaft 13 is pivotally supported on the supporting members 11 and 12. A lever 64 is fixed to the shaft 13, and rotated by a predetermined angle. When shaft 13 is pivoted in the counter clockwise direction, supporting frames 14 and 15 are raised, and feeding rollers 22 and 23 are raised, so that a clearance for inserting book 2 is produced between the feeding rollers and the supporting surface 16.

A stopping member 66 is provided on the supporting surface 16 to move between a protruded position as shown and a retracted position. The up/down movement of the stopping member 66 is performed by a mechanism well known in the art. When power to the printer is turned on, a drive source 63 is activated to move the lever 64 in the direction of arrow 61, thereby pivoting supporting frames 14 and 15 around the pivoting shaft 13 in the counter clockwise direction by the predetermined angle. Thus, the feeding rollers 22 and 23 are raised from the supporting surface 16, and stopping member 66 is moved to the raised position. This condition is a standby condition of the printer.

The operator inserts book 2 with the pages opened as shown in the FIG. 1 into the feeding path in the direction of the arrow 27 until it is stopped by the member 66. The bound portion 1 of book 2 is loosely positioned within channel 17 shown in the FIG. 2. When the operator turns on a start button located on an operator panel, a detecting device 71 generates a detecting signal indicating the presence of book 2 in the path. Detecting device 71 directs light onto the book 2 and detects the reflected light from book 2 or the failure of light to pass through to a sensor because of the presence of book 2.

A control device 8 (FIG. 3) responds to the detecting signal to move the stopping member 66 downwardly and to deactivate driving source 63. As a result, lever 65 is rotated around a pivot point 70 in the clockwise direction to move the feeding rollers 22 and 23 to the surface of the pages of the book 2. Contact of these rollers to the left and right pages of the book 2 is described hereinafter. Next, control device 8 activates stepper motor 62. Stepper motor 62 rotates shaft 20 of the pulley 57 in the clockwise direction, so that the feeding rollers 24 and 25 mounted below the supporting surface 16 are rotated in the clockwise direction, and the feeding rollers 22 and 23 are rotated in the counter clockwise direction, so that the book 2 is fed in the direction of the arrow 27.

Control device 8 knows the distance of the movement of the book 2 by counting the number of the steps of stepper motor 62. When the location wherein a line is to be printed on book 2 reaches the print position 26 along which the lower end of the print head 5 moves, control device 8 deactivates stepper motor 62, and performs the print operation of this one line by moving the print head 5 along a guide shaft 31. When the print operation of the one line is completed, control device 8 raises the print head 5, and activates stepper motor 62 to perform the line feed, that is, to feed the book 2 in the direction of the arrow 27 until the next line to be printed reaches below the print head 5, and the print operation of the next line is performed.

When all the print lines are printed, control device 8 rotates stepper motor 62 in the reverse direction to feed book 2 in the direction of arrow 28 for ejecting the book.

(B) Description of Control System of the Printer

Figure 3:
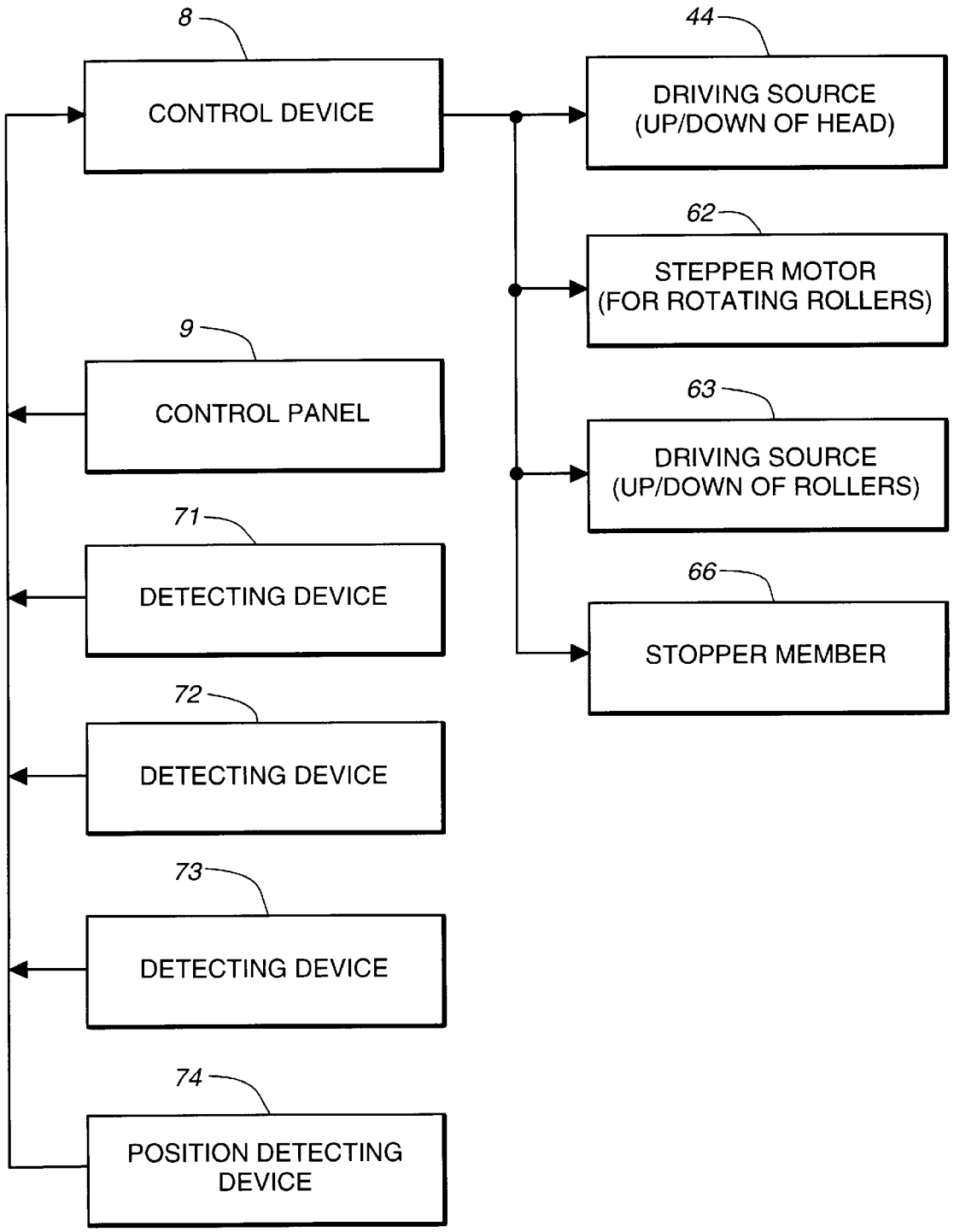
FIG. 3 shows the control system of the printer of the present invention.

FIG. 3 shows the control system of the printer. Control device 8 of the printer includes a microprocessor and controls the entire operation of the printer. The control device 8 responds to the detected signals from the detecting devices 71, 72, 73, or 74 to control the operation of the driving stepper motor 62, the driving source 44, the driving source 63, the stopping member 66 and the print head 5. The general operation of the control device 8 is described hereinbefore in section (A), and the remaining operation of the control device 8 is described hereinafter.

(C) Description of the Feeding Mechanism

As seen in FIG. 2, the feeding mechanism is described. A fixed shaft 54 is supported by the members 11 and 12 on supporting surface 16. Fixed shaft 54 fixedly supports the rear ends of springs 47 and 48, and the leading portions of the springs engage with the supporting frames 14 and 15 to bias their rotating shafts 18 and 19 towards supporting surface 16. The pivoting shaft 13 is pivotally supported on the supporting members 11 and 12, with the shaft 13 being parallel to supporting surface 16. In the printer in accordance with the present invention, the supporting shaft 13, which is kept in parallel to supporting surface 16 of the frame 10 is treated as the positional reference for mounting the components or parts of the printer.

As shown in FIG. 2, channel 17 is provided in surface 16 at a middle point between the supporting members 11 and 12. The direction of the channel 17 is perpendicular to the pivoting shaft 13. The depth and width are determined to loosely receive the bound portion 1 of book 2. Detecting device 71 is mounted at the entrance point of the book 2 of supporting surface 16 of the frame 10. Detecting device 71 detects only the entrance of book 2, and detects the reflected light from the book 2 or the failure of light to pass to a sensor positioned above book 2. Since this kind of the detecting device is well known in the art, a detail description is omitted.

Lever 64 is fixed to one end of pivotable shaft 13 and engages driving lever 65. Driving lever 65 is mounted to frame 10 at pivot point 70. When driving lever 65 is moved by driving source 63 provided within frame 10 in the direction of arrow 60, lever 64 is rotated in the counter clockwise direction, thereby pivoting shaft 13 so that it rotates relative to supporting members 11 and 12 in the counter clockwise direction. Whenever lever 64 is not rotated, pivoting shaft 13 is likewise not rotated. A pulley 56 is rotatably mounted on one end of pivoting shaft 13. One end of each of the supporting frames 14 and 15 is pivotally supported on the pivoting shaft 13. The supporting frames 14 and 15 independently pivot on shaft 13 in the direction which is perpendicular to the direction of the axes of the shaft 13.

A rotating shaft 18 is mounted on the other end of supporting frame 14, i.e., on the down stream side of the pivoting shaft 13 viewed in the direction of arrow 27, in parallel with shaft 13. Accordingly, rotating shaft 18 is kept in a parallel relation to both supporting surface 16 of frame 10 and the pivoting shaft 13. Feeding rollers 22 is fixed on the rotating shaft 18. A pulley 55 is fixed to one end of rotating shaft 18. The pulleys 55 and 56 are coupled by a belt 58, hence the pulley 55 and the feeding rollers 22 and 23 are rotated in the same rotating direction as that of the pulley 56. A rotating shaft 19 is mounted on the other end of the supporting frame 15, i.e. on the down stream of the pivoting shaft 13 viewed in the direction of the arrow 27, in parallel with the pivoting shaft 13. Accordingly, rotating shaft 19 is kept parallel to both supporting surface 16 of frame 10 and pivoting shaft 13, as in the case of the rotating shaft 18.

Feeding roller 23 is fixed on the rotating shaft 19. Feeding rollers 22 and 23 have the same diameters, and are made of the same material. When the lower ends of the feeding rollers 22 and 23 are positioned on supporting surface 16, the rotating shafts 18 and 19 are so mounted that the central axes of the rotating shafts 18 and 19 are aligned with respect to one another. The rotating shafts 18 and 19 are coupled by a universal joint 21. Accordingly, when pulley 55 is rotated in the counter clockwise direction, i.e. in the direction for feeding the book in the direction 27, the feeding rollers 22 and 23 are rotated at the same rotating speed, thereby applying the same feeding force to the left and right side pages of book 2.

A rotating shaft 20 is mounted within frame 10. Shaft 20 is parallel with the pivoting shaft 13, the rotating shaft 18, the rotating shaft 19 and supporting surface 16 of frame 10. For simplifying the drawing, the supporting mechanism of the rotating shaft 20 is not shown. Rotating shaft 20 is rotated by driving motor 62 in an opposite direction to the rotating direction of the upper side feeding rollers 22 and 23. A pulley 57 is fixed on one end of the rotating shaft 20, and this pulley 57 is coupled to the pulley 56 by a belt 59. Belt 59 is so mounted that when the pulley 57 is rotated in the clockwise direction, pulley 56 is rotated in the counter clockwise direction.

Feeding rollers 24 and 25 are fixed on rotating shaft 20 to oppose feeding rollers 22 and 23, respectively. Feeding rollers 24 and 25 preferably have the same diameters, and are made of the same material. An example of the material of feeding rollers 22, 23, 24 and 25 is silicone rubber. Rotating shaft 20 is mounted within frame 10, so that the level of the upper ends of the feeding rollers 24 and 25 is higher than the supporting surface 16 by a small distance. Feeding rollers 24 and 25 are protruded through apertures formed in the supporting surface 16. For the reasons that the pulley 55, 56 and 57 have the same outer diameters, and the feeding rollers 22, 23, 24 and 25 have the same diameters, the book 2 can be fed by the same feeding forces. Elements 67 and 68 are fixed on the pivoting shaft 13. These elements engages with the supporting frames 14 and 15 to raise them, respectively.

When power to the printer is turned on, control device 8 responds by activating driving source 63 so that lever 65 is rotated around pivot point 70 in the direction of arrow 60. Lever 64 is rotated in the direction of arrow 61, thereby pivoting shaft 13 and the members 67 and 68 are pivoted in the counter clockwise direction, to raise the supporting frames 14 and 15. As a result, the supporting frames 14 and 15 are rotated on the pivoting shaft 13 in the counter clockwise direction, thereby raising the upper side of feeding rollers 22 and 23, and a clearance is produced between the upper side feeding rollers and the lower side feeding rollers. This clearance is selected to be larger than the expected largest thickness of the book. This condition is a standby condition of the printer, as described hereinbefore. The operator can place the book 2 with the pages opened below the feeding rollers 22 and 23 until the leading edge of the book is stopped by stopping member 66.

As described hereinbefore, to urge the feeding roller 22 to the feeding roller 24, one end of the spring 47 is fixed on fixed shaft 54, and the other end of the spring engages with supporting frame 14 to bias the rotating shaft 18 in the clockwise direction around the pivoting shaft 13 in the FIG. 2. In a similar manner to urge feed roller 23 to feeding roller 25, one end of spring 48 is fixed on fixed shaft 54, and the other end of the spring 48 engages with supporting frame 15 to bias rotating shaft 19 in the clockwise direction around the pivoting shaft 13 in FIG. 2.

Figure 4:
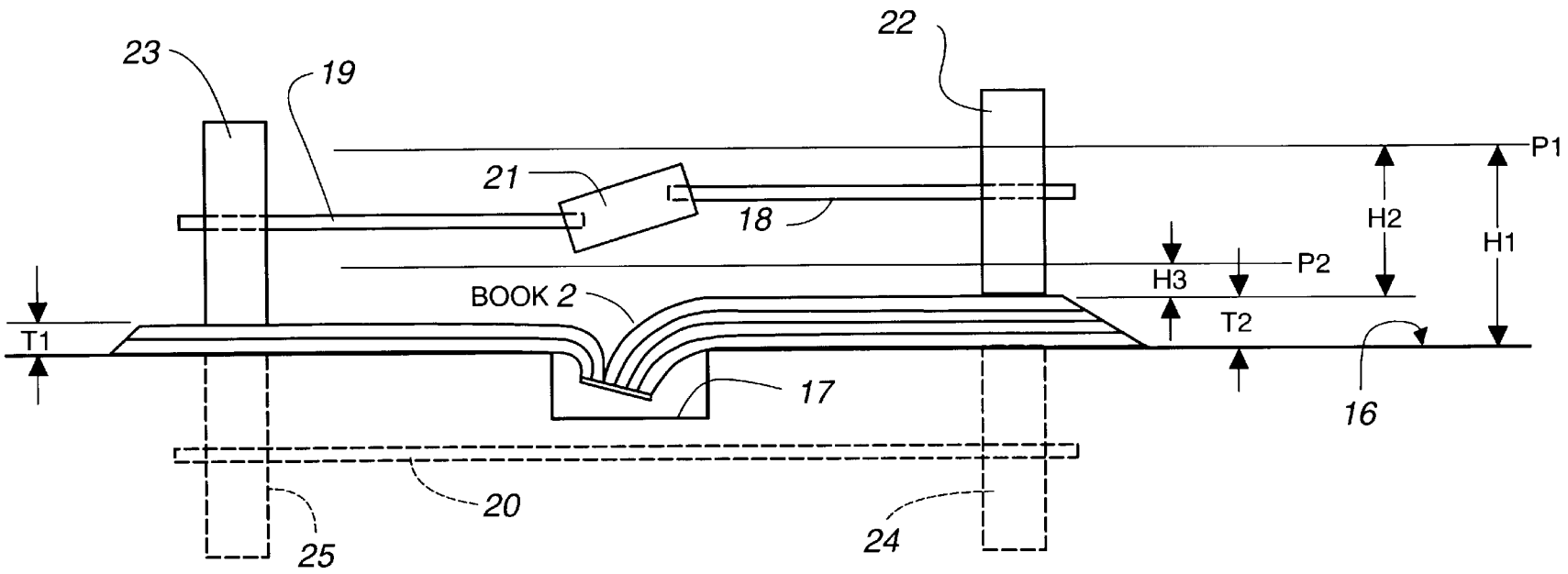
FIG. 4 shows the positional relationship of the feeding rollers to the left side pages and the right side pages.

As is apparent from FIG. 4, feeding roller 23 is raised in parallel to the supporting surface 16 of frame 10, since rotating shaft 19 is supported by supporting frame 15 in parallel to pivoting shaft 13. In the same manner, the feeding roller 22 is raised in parallel to supporting surface 16 of frame 10, since rotating shaft 18 is supported by the supporting frame 14 in parallel to the pivoting shaft 13. Further, supporting frames 14 and 15 can be independently rotated on the pivoting shaft 13, and rotating shaft 18 is coupled to the rotating shaft 19 by universal joint 21, thereby left side feeding roller 23 and the right side feeding roller 22 can engage with the left side and right side pages of the book to apply the same feeding speed to the pages.

Universal joint 21 transmits only the rotating torque from rotating shaft 18 to the rotating shaft 19 The force of spring 47 for biasing rotating shaft 18 and feed roller 22 to surface 16 is not transmitted to the rotating shaft 19. Similarly, the force of the spring 48 for biasing the rotating shaft 19, and the feeding roller 23 to the supporting surface 16 is not transmitted to the rotating shaft 18. Hence, the feeding rollers on supporting frames 14 and 15 are urged by only the bias force of the spring and their weight, whereby substantially the same feeding forces are supplied to the left side pages and the right side pages to feed the book 2. It is noted that the same feeding mechanism as that shown in the FIG. 2 can be mounted on the supporting surface 16 at a location indicated by dashed line 69.

(D) Description of the Mechanism for Moving the Print Head

In FIG. 2, again, the mechanism for moving print head 5 upwardly or downwardly in accordance with the present invention is shown. Print head 5 in the exemplary embodiment shown is a dot matrix type print head wherein a plurality of print wires are arranged in a line. Note that the dot matrix type print head is replaceable by other devices such as by an ink jet type print head. Print head 5 is slidably mounted on a guide bar 31 so that the lower end of the print head is moved along the line defining print position 26. The printer includes a mechanism for producing reciprocal movement of print head 5 in the rightward or leftward direction on the guide bar 31, and this mechanism is controlled by control device 8. Since such control of the print head along the guide bar 31 is well known in the art, a detail description thereof is not here presented.

In this example, a contemporary ink ribbon (not shown) is mounted in opposed relation to the face of print head 5. The printer preferably includes a page buffer for receiving character information to be printed and storing the character information of one page, means for selectively driving the print wires during the movement of the print head in accordance with the character information sequentially supplied from the page buffer, and a print control device controlled by the control device 8. This print control device is well known in the art, and is not described.

A supporting frame 30 includes an elongated member 30A extending in parallel to supporting shaft 13, and two short members 30B and 30C which extend from opposite ends of the member 30*a* in parallel to the supporting surface 16. The ends of the guide bar 31 are fixed to the end portion of each of the members 30B and 30C. Pivoting shafts 48 and 49 are attached at the positions on the members 30B and 30C adjacent to the elongated member 30A as shown. These pivoting shafts 48 and 49 are pivotally mounted on respective supporting frames 32 and 33 fixed on the frame 10. Frame 30 supports print head 5 to move it upwardly or downwardly in the vertical direction to the supporting surface 16, and the supporting frame 30 is applied with a bias force toward the supporting surface 16 due to the weight of the print head 5 and a spring, not shown.

An extended member 34 extends from the member 30A of frame 30 in the vertical direction to the print direction. A plate member 35 is fixed on a surface of extended member 34, and is parallel to the feeding direction (the direction of arrows 27 and 28) of book 2. Accordingly, plate member 35, extended member 34 and supporting member 30 are integral to the print head 5 and are moved with print head 5. A supporting frame 36 is fixed on the frame 10, and a lower end of the driving lever 38 is pivotally mounted relative to a pivot point 37 on the support frame 36. A driving lever 40 is pivotally attached with regard to driving lever 38 at a pivot point 41. Driving lever 40 is moved in the direction of arrow 42 or 43 by a driving source 44.

The direction indicated by the arrow 42 is the direction for moving the supporting frame 30 and print head 5 downwardly toward the supporting surface 16, and the direction indicated by the arrow 43 is the direction for moving the supporting frame 30 and the print head 5 upwardly from the supporting surface 16. Driving lever 38 engages with the supporting frame 30 to support the supporting frame 30 and the print head 5 which tend to rotate in the counter clockwise direction in FIG. 2 due to a bias force generated at least in part by the weight of print head 5 and supporting frame 30. The driving lever 38 disengages the supporting frame 30 after the print head 5 has landed on the uppermost page of the book. During nonprint operation, driving lever 38 supports frame 30 to position the lower end of print head 5 at the initial position P1 spaced from the supporting surface 16 by a predetermined distance.

During the print operation, driving lever 38 is selectively actuated to move the supporting frame 30 in the upward or downward direction. In the case that the driving lever 38 is pivoted around the point 37 in the clockwise direction (the direction of the arrow 43), the driving lever 38 moves the supporting frame 30 and print head 5 upwardly against the bias force. In the case that the driving lever 38 is pivoted around the point 37 in the counter clockwise direction (the direction of the arrow 42), the driving lever 38 supports the supporting frame 30 and print head 5 which tend to move downwardly by the bias force. Lever 38 suppresses rapid downward movement of supporting frame 30 and the print head 5, and slowly moves the supporting frame 30 and the print head 5 downwardly to the supporting surface 16. After print head 5 has landed on the sheet placed on the supporting surface 16, the driving source 44 for moving the driving lever 38 is continuously activated by the control device 8, so that the driving lever 38 is continuously moved and disengages from the supporting frame 30.

The term "sheet" means the uppermost page of the left or right side pages of the opened book 2, or a single sheet of paper such as a copy sheet, or plural stacked sheets of papers. The driving source 44 can include a DC motor or a stepper motor, a male screw coupled to the shaft of the motor, and a female screw attached to the driving lever 40. The male screw engages with the female screw. The rotation of the motor is converted into the movement in the direction of the arrow 42 or 43, and when the motor is stopped, the levers 38 and 40 are maintained at the stopped position.

A supporting member 39 for supporting a detecting device 73 is attached on the upper end of the driving lever 38. A detecting device 72 including a Light Emitting Diode (LED) 45 and a photodetector 46 is mounted on the frame 10 adjacent to one edge of the plate member 35. Plate member 35 moves with the print head 5 and is moved between the LED 45 and photodetector 46. The detail of supporting member 39 is shown in FIG. 5.

Figure 5:
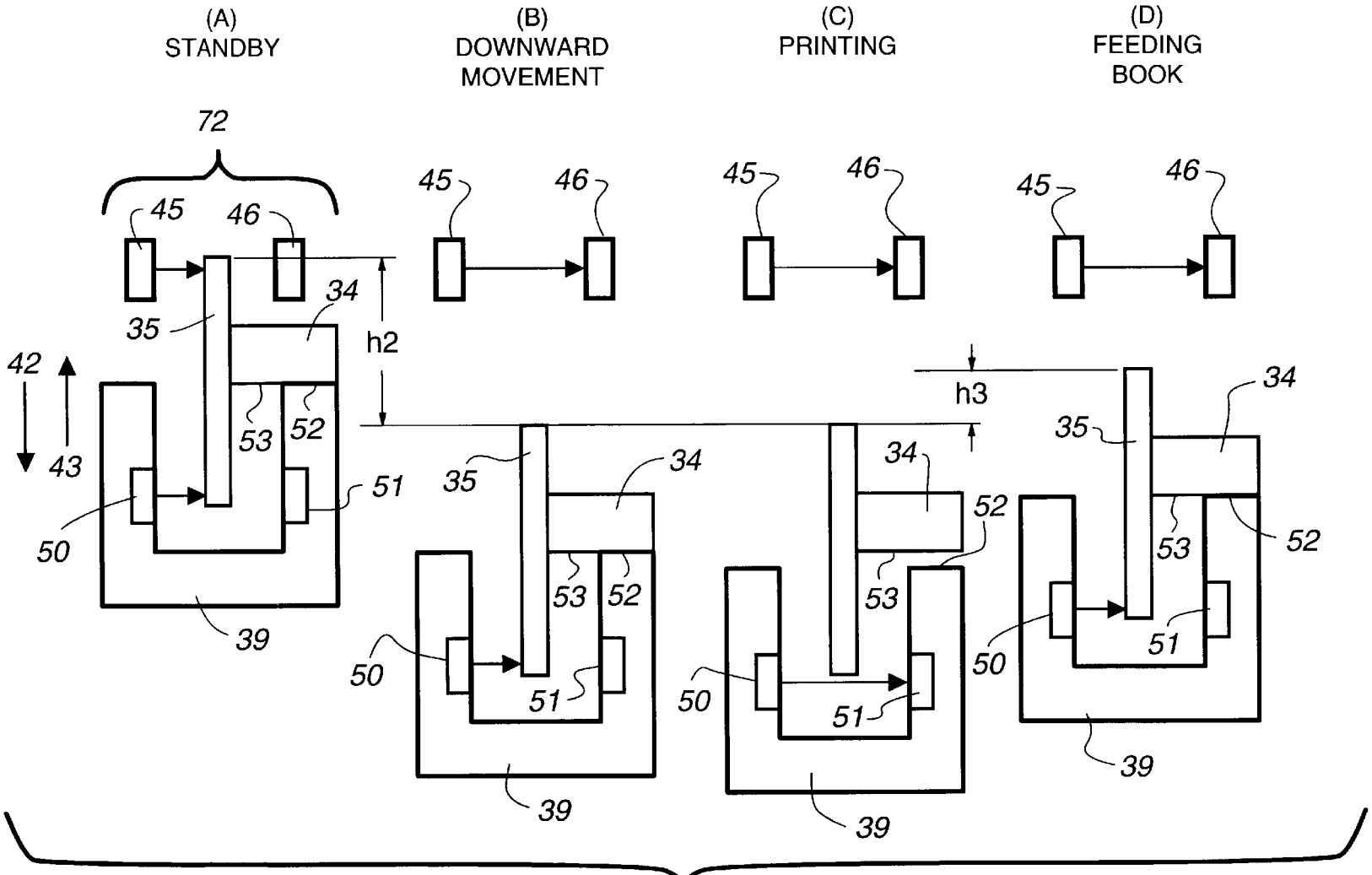
FIG. 5 shows the positional relationship of the detecting devices to the various parts of the printer.

FIG. 5 is a plan view of LED 45 and photodetector 46 of detecting device 72, the supporting member 39, the vertically extended member 34 and plate member 35. FIG. 5 shows the relative movement of print head 5 with respect to LED 45 and photodetector 46 mounted on frame 10, and a detecting device 73, including a LED 50 and a photo detector 51 within the supporting member 39. The supporting member 39 includes two recesses, and the LED 50 and the photo detector 51 of the detecting device 73 are mounted within respective such recesses.

Pursuant to FIGS. 2, 4 and 5, the movement of print head 5 in the direction which is perpendicular to the supporting surface 16 and the surface of the page of the book 2 is described. The first detecting device 73 and the second detecting device 72 are provided to control the movement of the print head 5 in the upward and downward movement in the vertical direction. Detecting device 73 generates a first detecting signal which represents that the supporting member 39 which is a portion of the driving lever 38 engages with the extended member 34 which is a portion of the supporting frame 30, and a second detecting signal which represents that the supporting member 39 which is a portion of the driving lever 38 disengages from the extended member 34 which is a portion of the supporting frame 30.

Detecting device 72 generates a first detecting signal which represents that the lower end of the print head 5 is positioned at the initial position P1, and a second detecting signal which represents that the lower end of the print head 5 is not positioned at the initial position P1. The detecting device 72 includes the LED 45 and the photo detector 46, and is mounted on frame 10. The LED 50 and photodetector 51 of the detecting device 73 are mounted within the supporting member 39. During the initial mode before the print operation of the printer, the levers 40 and 38 in FIG. 2 are pulled by the driving source 44 in the direction of arrow 43, under the control of control device 8, whereby the surface 52 of the supporting member 39 (FIG. 5) engages with the surface 53 of the extended member 34 to rotate the member 34 in the direction of the arrow 43, so that the supporting frame 30 is pivoted around the points 48 and 49 in the clockwise direction to move the print head 5 upwardly from the supporting surface 16.

That is, the driving lever 38 supports the supporting frame 30 from its lower side and the print head 5 which tend to move downwardly due to its bias force including their weight and the force of the spring, not shown. Since the surface 52 contacts surface 53, the detecting device 73 generates the first detecting signal indicating the contact of both the surfaces. When the plate member 35 which is moved with the print head 5 is moved to the position for blocking the beam from the LED 45, the photodetector 46 does not detect the light, and the first detecting signal indicating this condition is supplied to the control device 8. The first detecting signal indicates that the lower end of the print head 5 is raised to the initial position P1, whereby the control device 8 detects that the lower end of the print head 5 is raised to the initial position P1 separated from the supporting surface 16 by the distance H1, as shown in FIG. 4, and deactivates the driving source 44, so that the lower end of the print head 5 is maintained at the initial position P1.

Next, control device 8 responds to a print start signal, the first detecting signal from the first detecting device 73 and the first detecting signal from the second detecting device 72 to control the driving source 44 so that the lever 40 is moved in the direction 42 to move the supporting frame 30 downwardly, whereby the lower end of the print head 5 is moved downwardly from the initial position P1. The print head 5 and the supporting frame 30 are biased around the pivot points 48 and 49 in the counter clockwise direction due to their weight and the force applied by the bias spring, not shown.

Driving lever 38 supports the supporting frame 30 from its lower side and the print head 5 which tend to move downwardly by the bias force and suppresses the rapid downward movement of the supporting frame 30 and the print head 5, and slowly moves the supporting frame 30 and the print head 5 downwardly, thereby the lower end of the print head 5 slowly approaches to the surface of the page to be printed of book 2. During the movement from the initial position P1, the plate member 35 moved with the print head 5 leaves the light path of the LED 45. Thus, light is detected by photodetector 46, which sends the second detecting signal to control device 8. The surface 53 of the extended member 34 continues to engage with the surface 52 of the supporting member 39, as shown in FIGS. 5 (A) and (B).

Accordingly, the plate member 35 continues to block the light from the LED 50 of the detecting device 73, and photodetector 51 continues to generate the first detecting signal, and the detecting device 72 continues to generate the second detecting signal. The control device 8, accordingly, recognizes that the lower end of the print head 5 is moving downwardly from the initial position P1 to the surface of the book, and continues to activate the driving source 44. As shown in FIG. 4, when the lower end of the print head 5 has softly landed on the surface of the book 2 after the movement of the distance H2 from the initial position P1, the plate member 35 which is integral to the print head has been moved over the distance h2 which corresponds to H2. When the print head has landed, the movement of the supporting frame 30, the extended member 34 and the plate member 35, which are moved with the print head 5 is stopped. It is noted that when lower end of the print head 5 is landed, there is a small clearance between the print wires and the surface of the page to be printed.

At the landing of the print head, the detecting device 73 generates the first detecting signal, hence the control device 8 continues to activate the driving source 44, thereby the levers 40 and 38 are moved in the direction of the arrow 42, and the supporting member 39 is continuously moved in the direction 42. Plate member 35 has already stopped and leaves the light path of the LED 50 of the detecting device 73, so that photodetector 51 of detecting device 73 applies the second detecting signal to the control device 8. At this time, the detecting device 72 generates the second detecting signal, and the control device 8 responds to these signals to immediately deactivate the driving source 44, to stop the lever 40, so that, as shown in FIG. 5 (C), the surface 52 of the supporting member 39 is separated from the surface 53 of the extended member 34 by a small clearance G.

It is noted that this clearance G is a constant value irrespective of the height of the pages of the book 2, since the levers 38 and 40 are immediately stopped after the detection of the second detecting signal of the detecting device 73 which indicates the landing of the print head on the page. Accordingly, as described below, levers 38 and 40 can be immediately raised from this position which is spaced by the constant distance G, when the print operation is completed. The print operation is performed in this condition in which the lower end of the print head 5 lands on the page, and the levers 38 and 40 are stopped at the position spaced by the gap G. The print operation is performed under the control of the control device 8, by selectively activating the print wires during the movement of the lower end of the print head 5 along the print position 26.

The reasons for using LED 50 and photodetector 51 as the detecting device 73 and the plate member 35 are to precisely detect the occurrence of the small gap G between the surface 53 of the extended member 34 and the surface 52 of the supporting member 39. As the gap G becomes smaller, a time period for raising the lever 38 from the condition shown in the FIG. 5(C) becomes shorter, whereby the print speed can be increased. Also, the weight, size, and cost of the LED 50 and the photodetector 51 is small, hence the fabrication cost of the printer is decreased. Any device employed in place of the elements shown for detector 73 must have the capability of sensing the above small gap.

As described above, the extended member 34 is provided on the member 30A to extend in the direction which is perpendicular to the print direction. One end of the driving lever 38 is pivoted on the supporting frame 36 to pivot in the direction which is perpendicular to the print direction. Member 39 at the end of driving lever 38 engages with the extended member 34, and the detecting device 73 includes the LED 50 and the photodetector 51 mounted within the member 39 to detect the movement of the plate member 35.

Next, the operation for raising the lower end of print head 5 after the print operation is described. It is assumed that the operation mode is intended for separately printing the left side page or the right side page of book 2, and that the page is printed by the print head 5 in the direction from the left side to the right side of the page. When the print head 5 has reached the right side of the line after the print of this line, the control device 8 responds to this completion of print, as well as to the second detecting signal of the detecting device 72, and the second detecting signal of the detecting device 73 to activate the driving source 44 to move the levers 40 and 38 in the direction 43 so that the supporting frame 30 is raised, and the lower end of print head 5 is stopped at the standby position in printing P2. Position P2 is spaced from the surface of the page by a predetermined distance that is lower than the initial position P1. The standby position in printing P2 is the minimum distance from the surface of the page to space the lower end of the print head 5 from the surface of the page when the book is fed by one line in the line feed operation. This standby position in printing P2 is determined at designing the printer.

To stop at the standby position P2, the control device 8 activates the driving source 44 to move the lever 40 in the direction 43, whereby the surface 52 of the supporting member 39 engages with the surface 53 of the extended member 34 to move the member 34 in the direction 43 to raise the lower end of the print head 5 from the surface of the page of the book 2.

As shown in FIG. 5(D), as the surface 52 is engaging with the surface 53, the plate member 35 blocks the light from the LED 50, so that photodetector 51 stops the second detecting signal, and generates the first detecting signal. To stop the lower end of the print head 5 at the standby position in printing P2, a position detecting device 74 (FIG. 3) is provided for detecting the arrival of the lower end of print head 5 at the position P2. Control device 8 responds to the position detecting signal from the detecting device 74 to stop the driving force of the driving source 44 which is applied to the driving levers 40 and 38 to move the supporting frame 30 upwardly in the direction 43.

In the succeeding line print operations, the control device 8 uses the standby position P2 in place of the initial position P1, and causes the lower end of the print head 5 to start from the standby position P2. In the case that the DC motor is used as the motor of the driving source 44, the control device 8 starts the rotation of the DC motor from its rotational position which caused the lower end of the print head to land on the page in FIG. 5(C) to generate the driving force in the direction 43 and stops the DC motor after a lapse of a predetermined period from the start of the rotation of the DC motor. This predetermined time period is required to rotate the DC motor to stop the lower end of the print head 5 at the standby position in printing P2 spaced from the surface of the page by the distance H3 in FIG. 4. This time period is selected at the design stage of the printer.

In FIG. 5(D), plate member 35 is moved over the distance h3 which corresponds to the distance H3 in the direction 43. The position detecting device 74 used in the case wherein a DC motor is used as the motor of the driving source 44 includes an establish means for establishing the second driving period (i.e., the predetermined time period described above) which is shorter than a first driving period during which the lower end of the print head 5 moves from the initial position P1 to the surface of the page of the book, and a timer which generates the position detecting signal after a lapse of the second driving period from the start of the motor.

In the case that a stepper motor is used as the motor of the driving source 44, the control device 8 rotates the stepper motor by the number of steps which are required to move the plate member 35 by the distance h3. This number of steps is also determined at the design stage. The position detecting device 74, used in the case that the stepper motor is used as the motor of the driving source 44, includes a means for establishing a second number of steps (i.e., the number of steps described above) which is smaller than a first number of steps during which the lower end of the print head 5 moves from the initial position P1 to the surface of the page of the book, and a means which generates the position detecting signal after the rotation of the second number of steps of the stepper motor from its rotational position which caused the lower end of the print head to land on the page.

As a result, the lower end of the print head 5 is stopped at the right end of the printed line at the height of the standby position in printing P2 spaced from the surface of the page by the distance H3. In this condition, the book is fed by one line in the direction 27, and the print head 5 is returned on the guide bar 31 to the left side of the next print line of the same page, under the control of the control device 8. Next, control device 8 activates the driving source 44 to move the lever 40 in the direction 42 to land the lower end of the print head 5 on the page, as shown in the FIG. 5(C), and in this condition, the photodetector 51 of the detecting device 73 detects the light and generates the second detecting signal, and the detecting device 72 generates the second detecting signal. The control device 8 responds these condition, to deactivates the driving source 44, and starts the print operation.

In this manner, when only one page of the book is printed, the lower end of the print head is moved downwardly from the initial position at the print of the first line, and during the line feed for the succeeding lines, the lower end of the print head 5 is raised to the standby position in printing P2. The book 2 is then fed by one line in the direction 27 and the print head 5 is moved back to the first print position on the guide bar 31. When the print head reaches the first print position, the lower end of the print head 5 is moved downwardly to the surface of the page to print the line. In this manner, the movement of the print head 5 in the vertical direction to the surface of the page is remarkably decreased, thereby the print speed can be increased.

In contradistinction, it is possible to print one print line of the left side page, and to move the print head 5 to the beginning of one line of the right side page passing through the bound portion 1, and to print this one line of the right side page. In this print mode, the lower end of the print head 5 is moved downwardly from the initial position P1 to the first print position of one line of the left side page, and prints this one line. After this line has been printed, the lower end of the print head 5 is moved to the initial position P1, and the print head 5 is moved horizontally at the height of the position P1 to the first print position of one line of the right side page through the bound portion 1.

When the print head 5 reaches to a position above the first print position of the line of the right side page, the print head 5 is moved downwardly to start the printing operation. When the print operation of this one line has been completed, the lower end of the print head 5 is again moved upwardly to the initial position P1, and the feeding rollers are rotated to feed the book 2 by one line, and the print head 5 is moved horizontally at the height of the position P1 to the first print position of the next line of the left side page through the bound portion 1. When print head 5 reaches the first print position of the next line of the left side page, the print head 5 is again moved downwardly to start the printing operation.

The selection of the mode in which the lines of one page are continuously printed, or the mode in which the lines of the both pages are alternately printed, is performed by user selection of a mode switch or button on an operator panel, and the control device senses the selection, and performs the above operation. By using the stepper motor as the driving motor of the driving source 44, the movement of the print head 5 shown in FIG. 6 can be performed. In this operation, the movement in the vertical direction is reduced, and, it is possible to print the first print line of the left side page of the book in which the height of the left side pages differs from the height of the right side pages, to move the print head to the right side page without performing the line feed operation, to print the first line of the right side page, to feed the book by one line, to print the second line of the left side page, and to print the second line of the right side page. The FIG. 6 shows such a print operation.

Figure 6A:
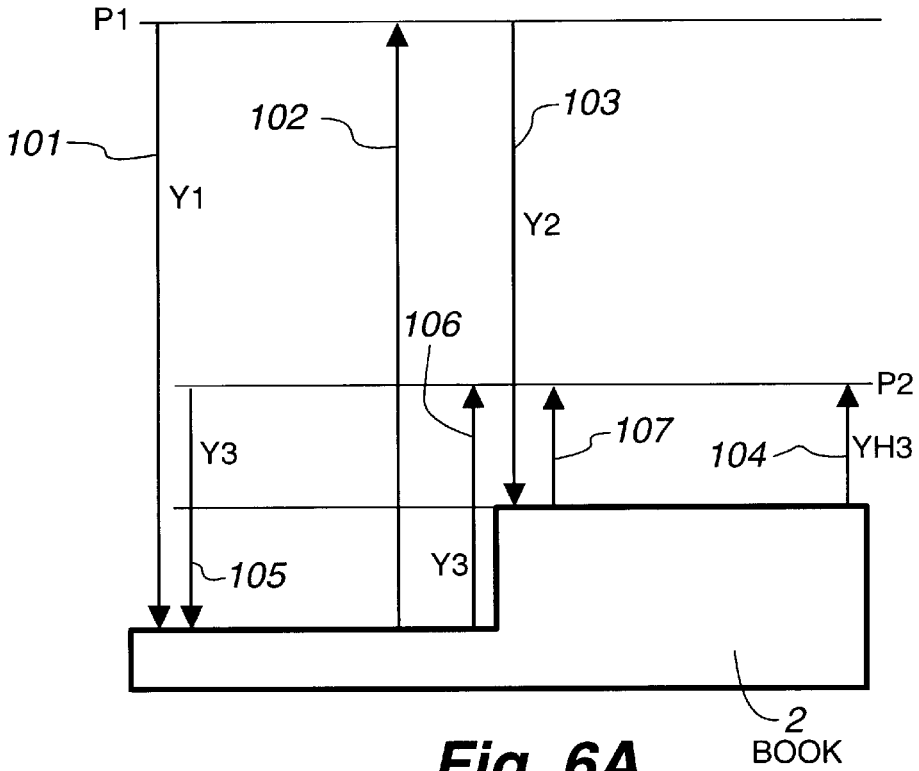
FIG. 6 shows the height of the print head from the book with FIGS. 6(A) and (B) showing the movement of the print head relative to the book.
Figure 6B:
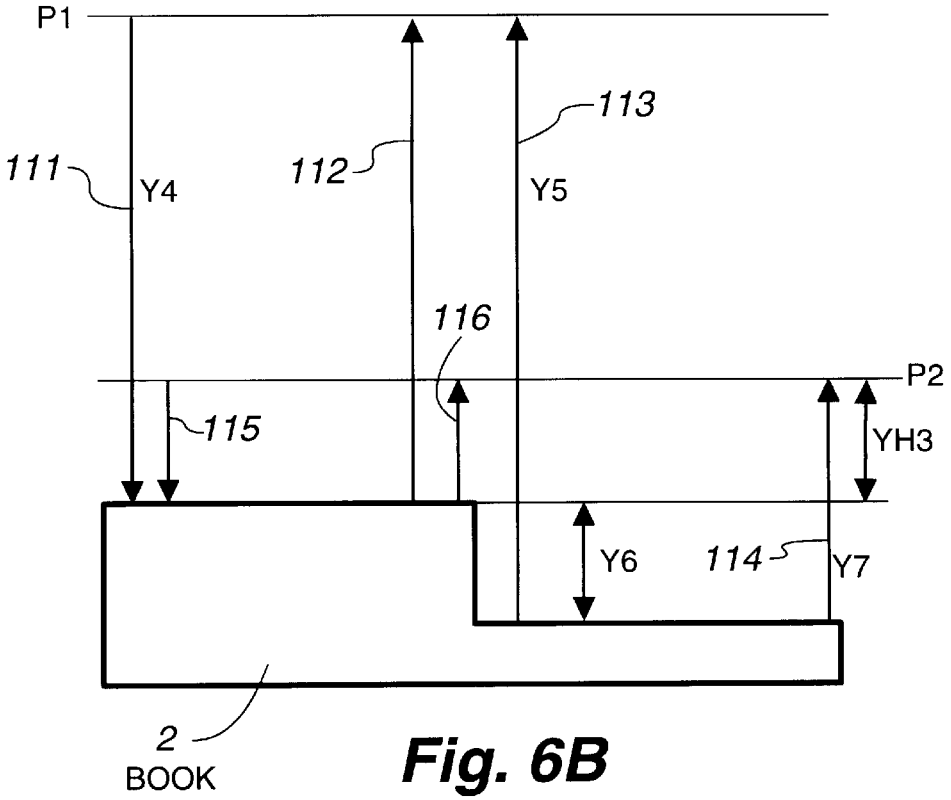

FIG. 6(A) shows the first case in which the height of the left side pages is lower than the height of the right side pages, and FIG. 6(B) shows the second case in which the height of the left side pages is higher than the height of the right side pages. The following operation can be performed by the control device 8 which controls the stepper motor of the driving source 44, in the manner described with respect to FIG. 5.

Describing the first case, the lower end of the print head 5 at the height of the initial position P1 is moved to a position above the first print position of the first print line of the left side page, and is downwardly moved to the first position in the direction 101, and lands on the left side page. During the movement in the first direction 101, the control device 8 counts the number of rotating counts of the stepper motor to detect the first downward distance Y1 and stores it. The number of rotating counts corresponding to the first downward distance Y1 can be detected by counting the counts or steps from the status of FIG. 5(A) to the status of FIG. 5(C).

Control device 8 with the microprocessor includes a device for determining the number of the steps of the stepper motor. This device includes a counter which receives the step pulses applied to the stepper motor and is incremented by the step pulse, and a latch which holds the count generated by the counter. The print operation of the first print line is performed, and the print head 5 reaches the right area of the left side page, when the lower end of the print head 5 is raised to the standby position P1 in the second direction 102. Then, the print head 5 maintained at the height P1 is moved on the guide bar 31 to the position above the first print position of the first print line of the right side page, and the lower end of the print head 5 is moved in the first direction 103 from the initial position P1 to the surface of the page.

During this downward movement, the control device 8 counts the number of rotating counts of the stepper motor to determine the second descending distance Y2 and stores it. Control device 8 compares the first distance Y1 for the left side page with the second distance Y2 for the right side page, detects the relation Y1>Y2, and performs the print of the first line of the right side page. In the case wherein Y1>Y2, the control device 8 raises the lower end of print head 5 now in the right area of the right side page by the distance YH3 along the second direction 104 which corresponds to the distance H3 in FIG. 4.

Next, the control device 8 feeds book 2 by one line, and moves the lower end of print head 5 horizontally at the height of the standby position P2 to the position above the first print position of the second print line of the left side page. The lower end of the print head 5 is moved downwardly from the standby position P2 to the left side page along the direction 105. During this downward movement 105, control device 8 counts the number of rotating counts of the stepper motor to determine the descending distance Y3. This distance Y3 is determined by counting the number of the rotating steps from the start of the stepper motor to the status of FIG. 5(c). The print operation of the second line is performed, and the print head 5 reaches the right end of the line.

Next, the control device 8 moves the lower end of print head 5 upwardly by the distance equal to the distance Y3 in the second direction 106. The raised position at this time is equal to the position P2 raised by the distance YH3 in the right side page. Control device 8 moves print head 5 horizontally on the guide bar 31 by keeping the height P2 to the position above the first print position of the second line of the right side page. The lower end of the print head 5 is moved downwardly in the direction 107 from the standby position P2 to the page, prints this second line, and reaches the right end of this line. Next, control device 8 moves the lower end of print head 5 upwardly by the distance YH3 in the second direction 104, book 2 is fed by one line, and print head 5 is horizontally moved on guide bar 31 to the first print position of the next line of the left side page, after which the above operation is repeated.

In this manner, during the print operation of the first line of both the left and right pages, control device 8 determines the first and second distances Y1 and Y2 from the initial position P1. If Y1>2, control device 8 selects the raised position P2 separated by the distance YH3 (corresponding to the distance H3 in FIG. 6) from the surface of the page which generates the lesser distance Y2, as the maximum upward position of the print head 5 for printing the next lines of both the right and left pages. That is, the control device 8 identifies the right side page which generates the lesser distance Y2 by comparing the first distance Y1 with the second distance Y2, establishes the standby position P2 above the right side page which generates the lesser distance Y2, and moves the lower end of the print head 5 in the second direction to the standby position P2 after the left side or right side page is printed.

In the second case shown in FIG. 6(B), the lower end of print head 5 is moved downwardly from the initial position P1 to the first print position of the first print line of the left side page in the first direction 111, and lands on the page. During the movement in the first direction 111, control device 8 counts the number of steps of the stepper motor to determine the first distance Y4. The number of steps corresponding to the first distance Y4 can be determined by counting the number of steps from the status of FIG. 5(A) to the status of FIG. 5(C). Print head 5 prints the first line, and reaches the right end of the line. The lower end of the print head 5 is raised to the initial position P1 in the second direction 112.

Print head 5 is then moved to the position above the first print position of the first print line of the right side page where it is moved downwardly from the initial position P1 to the surface of the page in the first direction 113. During this downward movement, the control device 8 counts the number of rotating steps of the stepper motor, to determine the second distance Y5. Control device 8 compares the first distance Y4 for the left side page with the second distance Y5 for the right side page, and detects the relation Y4<Y5. Control device 8 calculates the difference Y6 between Y5 and Y4, i.e. Y6=Y5−Y4, and prints the first line of the right side page. In this case where Y4<Y5, control device 8 raises the lower end of the print head 5 at the right end of the right side page to the standby position P2 which is spaced by the distance Y6+YH3 in the second direction 114.

Next, control device 8 feeds the book 2 by one line, and moves the lower end of the print head 5 horizontally toward the position above the first print position of the second line of the left side page by keeping the height P2 (separated by the distance T6+YH3). In the left side page, the lower end of print head 5 is kept at the height P2 separated by the distance YH3 (which corresponds to the distance H3 in FIG. 6) from the left side page. Next, the control device 8 moves downwardly the lower end of the print head 5 to the left side page, as indicated by the arrow 115 to print the line, and the lower end of the print head 5 reaches the right end of the second line. Control device 8 raises the lower end of print head 5 to the position P2 in the second direction 116. Control device 8 moves horizontally the print head 5 to the first print position of the second line of the right side page while keeping the height P2. The lower end of print head 5 is moved to the line of the page, prints this line, and reaches the right end of the second line of the right side page. The lower end of the print head 5 is moved upwardly to the position P2 by the distance Y6+YH3=Y7 in the second direction 114, book 2 is fed by one line, and print head 5 is horizontally moved to the left end of the left side page after which the above-described operation is repeated.

In this manner, during the print operation of the first line of both the left and right pages, the first and second fall down distances Y4 and Y5 from the initial position P1 are detected, and if Y4<Y5, control device 8 selects the raised position P2 separated by the distance YH3 (corresponding to the distance H3 in FIG. 6) from the surface of the page which generates the lesser distance Y4, as the maximum upward position of the print head 5 for printing the next lines of both the right and left pages. That is, the control device 8 identifies the left side page which generates the lesser distance Y4 by comparing the first distance Y4 with the second distance Y5, establishes the standby position P2 above the left side page which generates the lesser distance Y4 in this example. The lower end of print head 5 is moved in the second direction to the standby position P2 after the left side or right side page is printed.

By the above-described print operation, the lower end of the print head 5, in accordance with the present invention, does not move down from the initial position P1 for every print line, as is performed in the prior art printers. During the print operation of the second line and the succeeding print operation, print head 5 in accordance with the present invention is reciprocally moved between the surface of the page and the standby position in printing P2, which is separated by the distance YH3 from the surface of the page, so that the movement of the print head 5 in the vertical direction to the page is remarkably reduced, thereby the print speed is increased. The first distance Y1 (Y4) and the second distance Y2 (Y5) can be measured before printing operation. To this end, the control device 8, before performing the print operation, measures the first distance by moving the lower end of the print head 5 from the initial position P1 to the surface of the left side page; then moving upwardly the lower end of the print head 5 to the initial position P1; sliding the print head 5 on the guide bar 31 to move the print head 5 to the position above the right side page while keeping the position P1; moving the lower end of the print head 5 from the initial position P1 to the surface of the right side page; comparing the first fall down distance with the second fall down distance to identify the page which generates the lesser descent distance; establishing the standby position P2 above the page which generates the lesser descending distance; and maintaining the lower end of the print head 5 at the initial position P1.

After this initial measurement, control device 8 starts the print operation of the book. During the print operation, the lower end of print head 5 is raised to the standby position P2 after printing the line, and the line feed operation is performed. The lower end of the print head 5 is moved downwardly from the standby position P2 to the page. Although the detecting device 73 is mounted on the supporting member 39 of the driving lever 38, it can be mounted in other suitable arrangements such as on vertical member 34. In addition, while a printer having the horizontal supporting surface 16 is described, the supporting surface 16 can be inclined from the horizontal plane.

The present invention is particularly meritorious and advantageous in its affects upon minimization of print head movement. In the prior art printers, the driving lever 38 (39) remains at the level of the supporting surface 16 during the print operation, and is raised from this level toward the top page of the book for each line feed operation to engage and raise the supporting frame 30 and the print head 5 on the frame 30. This movement of the driving lever between the level of the supporting surface 16 and the level of the top page decreases the printing speed of the printer.

The present invention solves the problem. According to the present invention, the control device 8 responds to the second detecting signal from the detecting device 73 which indicates that the lower end of the print head 5 has landed on the top page of the book, the height of which is not known, to immediately deactivate the driving source 44 to stop the driving lever 40, so that the surface 53 of the extended member 34 is spaced from the surface 52 of the supporting member 39 by the small gap G, as is shown in FIG. 5(C). This gap G is the constant distance irrespective of the height of the top page of the book. Driving levers 40 and 38 can be raised from this position shown in FIG. 5(C) for performing the line feed operation, after the print operation of the one line is completed, whereby the unnecessary movement of the driving lever in the prior printer is solved, and the printing speed can be improved.

Further, the prior movement of the print head in the vertical direction to the surface of the page was remarkably long since the lower end of the print head is moved downwardly from the initial position P1 which is spaced from the supporting surface 16 by the longer distance than the expected maximum thickness of the book to print the line of the page, and after the line has been printed, the lower end of the print head is raised to the initial position P1, whereby the printing speed is remarkably decreased. In accordance with the present invention, in the printing of the second and succeeding lines, the lower end of the print head 5 is lowered from the standby position in printing P2, and is moved between the standby position P2 and the surface of the top page, so that the movement of the print head 5 in the vertical direction is remarkably decreased, whereby the print speed is remarkably increased.

In the case wherein the lower end of the print head is positioned on the left side page, or right side page in which the heights of these pages differ from each other, the lower end of the print head 5 is lowered from the standby position in printing P2, and is moved between the standby position P2 and the surface of the top page, so that the movement of the print head 5 in the vertical direction is remarkably decreased, whereby the print speed is remarkably increased. In accordance with the present invention, it is possible to measure the distance between the initial position P1 and the top page of the left and right side pages of the book by using the print head. The measurement can be made in the print operation or before the print operation. In this manner, the print head is also used for measuring the height.

When the driving lever 38 is driven to move the supporting frame 30 downwardly in the print operation, the driving lever 38 supports the supporting frame 30 from its lower side and the print head 5, which tend to move downwardly due to the bias force, such as their weights possibly augmented by a spring force, to suppress the rapid downward movement of the supporting frame 30 and the print head 5, whereby the print head 5 is softly landed on the top page.

Description of the Reference Numbers

1—binding or bound portion of book; 2—book; 5—print head; 8—control device; 10—frame; 13—pivoting shaft; 14, 15—supporting frame members; 16—supporting surface; 17—channel; 22, 23, 24, 25—feeding rollers; 18, 19, 20—rotating shafts; 21—universal joint; 26—print line; 30—supporting frame; 31—guide bar; 34—extended member; 35—plate member; 38, 40—driving levers; 39—supporting member; 44—driving source; 45, 50—LED; 26, 51—photo detector.

While the exemplary preferred embodiments of the present invention are described herein with particularity, those having normal skill in the art will recognize various changes, modifications, additions, and applications other than those specifically mentioned herein without departing from the spirit of this invention.

What is claimed is:

1. In a printer in which a print head is moved on a sheet placed on a planar supporting surface in a predetermined print direction, and said sheet is fed in a perpendicular direction to said print direction to print a plurality lines, said printer comprising:

a guide bar slidably mounting said print head thereon;

a supporting frame for supporting said guide bar in parallel to said supporting surface and said print direction, said supporting frame supporting said guide bar for movement upwardly or downwardly to position a lower end of said print head relative to said supporting surface, and said supporting frame being downwardly biased by a bias force;

a driving lever driven during non-print operation for moving upwardly with respect to said supporting frame to raise said lower end of said print head to an initial position located above said supporting surface, which is spaced from said supporting surface by a predetermined distance, and for maintaining said lower end of said print head at said initial position, said driving lever, during print operation, being driven for moving upwardly or downwardly with respect to said supporting frame, in which, when said driving lever is driven in the direction for moving upwardly with respect to said supporting frame, said driving lever engaging with said supporting frame to move upwardly relative to said supporting frame against said bias force, and when said driving lever is driven in the direction for moving downwardly said supporting frame, said driving lever engages with said supporting frame to suppress a rapid downward movement of said supporting frame due to said bias force to slowly move downwardly said supporting frame, and said driving lever continuously moving downwardly during the time a driving force is applied to said driving lever, and disengaging from said supporting frame after said lower end of said print head lands on said sheet placed on said supporting surface;

a driving source for applying said driving force to said driving lever;

a detecting device for detecting an occurrence of a clearance between said driving lever and said supporting frame occurred by said disengagement of said driving lever from said supporting frame during said continuous movement of said driving lever; and a control device responding to a print start signal for activating said driving source to apply said driving lever with a downward driving force for moving said supporting frame downwardly, and said control device responding to a detecting signal indicating said occurrence of clearance generated by said detecting device to deactivate said driving source to terminate the application of said downward driving force to said supporting frame to hold said driving lever at its stopped position, said control device responding to a completion of print operation of one line of said sheet to activate said driving source to apply said driving lever with an upward driving force for moving upwardly said driving lever from said stopped position to engage with said supporting frame to move upwardly with respect to said supporting frame.

2. A printer according to claim 1, said printer further comprising:

a position detecting means for detecting an arrival of said lower end of said print head at a standby position above said supporting surface for generating a position detecting signal, said standby position being spaced from said supporting surface by a predetermined distance, and said standby position being lower than said initial position, and characterized in that said control device responds to said position detecting signal to deactivate said driving source to terminate the application of said upward driving force to said supporting frame; and controls to move said lower end of said print head downwardly from said standby position for printing succeeding lines of said sheet.

3. A printer according to claim 2, wherein said driving source includes a DC motor and a converting means for converting rotation in one direction generated by said DC motor into said upward driving force and converting rotation in the other direction generated by said DC motor into said downward driving force, and said position detecting means includes means for establishing a second driving period of said DC motor which is shorter than a first driving period of said DC motor during which said lower end of said print head is moved from said initial position to said surface of said sheet; and a timer means for generating said position detecting signal at a lapse of said second driving period after said DC motor started said rotation in one direction from its rotational position causing said lower end of said print head to land on said sheet.

4. A printer according to claim 2, wherein said driving source includes a stepper motor and a converting means for converting rotation in one direction generated by said stepper motor into said upward driving force and converting rotation in the other direction generated by said stepper motor into said downward driving force, and said position detecting means includes means for establishing a second number of steps of said stepper motor which is smaller than a first number of steps of said stepper motor during which said lower end of said print head is moved from said initial position to said surface of said sheet, and a means for generating said position detecting signal when said stepper motor has rotated by said second number of steps from its rotational position causing said lower end of said print head to land on said sheet.

5. A printer according to claim 1, wherein said supporting frame includes a first member extending in parallel to said print direction, a second member extending from one end of said first member in a perpendicular direction to said print direction, and a third member extending from the other end of said first member in a perpendicular direction to said print direction, said second and third members being pivoted on a frame of said printer, both the ends of said guide bar being fixed on said second member and said third member, an extended member is provided to extend from said first member in a perpendicular direction to said print direction, one end of said driving lever being pivoted on said frame to pivot in a perpendicular direction to said print direction, and the other end of said driving lever is engaged with said extended member; and said detecting device includes a light emitting diode and a photodetector mounted on said driving lever, and generates said detecting signal indicating said occurrence of a clearance by said disengagement of said driving lever from said supporting frame when an interruption of the light from said light emitting diode by said extended member is terminated.

6. In a printer for printing a book including a plurality of stacked sheets bound at a bound portion in which said book is opened and said opened book is supported on a supporting surface and fed in a feed direction parallel to said bound portion, and a left side page and a right side page of said book are printed in a perpendicular direction to said feed direction, said printer comprising:

a moving means for moving a lower end of a print head in a first direction from an initial position which is spaced from said supporting surface by a predetermined distance, to said supporting surface, or in a second direction from said supporting surface to said initial position;

a control means for controlling said moving means, said control means including means for moving said lower end of said print head in a first direction from said initial position to one page of said left and right side page to measure a first distance between said initial position and said one page;

means for moving said lower end of said print head in a first direction from said initial position to the other page of said left or right side page to measure a second distance between said initial position and said other page; and means for comparing said first distance with said second distance to identify the page which generates the lesser distance to establish a standby position above the page which generates the lesser distance, said standby position being lower than said initial position, characterized in that said control device responds to said establishment of said standby position to move said lower end of said print head downwardly during printing of a succeeding line.

7. In a printer for printing a book including a plurality of stacked sheets bound at a bound portion in which said book is opened and said opened book is supported on a supporting surface and fed in a feed direction parallel to said bound portion, and a left side page and a right side page of said book are potential recipients of printing by a print head in a print direction which is perpendicular to said feed direction, said printer comprising:

first means for moving a lower end of said print head in a first direction from an initial position which is spaced from said supporting surface by a predetermined distance to said supporting surface, or in a second direction from said supporting surface to said initial position;

second means for moving said print head in said print direction;

third means for causing said print head to print a line;

fourth means for measuring a distance of movement of said lower end of said print head in a first direction from said initial position to said page, and a control means for controlling said first means, said second means, said third means and said fourth means, said control means performing steps of:

(a) moving said lower end of said print head while maintaining said print head at a height of said initial position along said print direction to a position which is located above first print position of first line of one page of said left side page and said right side page of said book;

(b) moving said lower end of said print head in said first direction from said initial position to measure a first distance between said initial position and said one page;

(c) printing said first line of said one page by moving said lower end of said print head in said print direction with contacting said lower end of said print head on said one page;

(d) moving said lower end of said print head in said second direction to said initial position after the completion of print of said first line;

(e) moving said lower end of said print head while maintaining the height of said initial position along said print direction to a position which is located above a first print position of a first line of the other page of said left side page and said right side page of said book;

(f) moving said lower end of said print head in said first direction from said initial position to measure a second distance between said initial position and said other page;

(g) printing said first line of said other page by moving said lower end of said print head in said print direction with contacting said lower end of said print head on said other page;

(h) comparing said first distance with the second distance to identify the page which generates the lesser distance to establish a standby position, which is lower than said initial position, above said page which generates the lesser distance, to move said lower end of said print head in said second direction from said the other page to said standby position, and to feed said book in a line feed direction;

(i) moving said lower end of said print head while keeping it at a height of said standby position along said print direction to a position which is located above first print position of second line of said one page;

(j) moving said lower end of said print head in said first direction from said standby position to said one page;

(k) printing said second line of said one page by moving said lower end of said print head in said print direction with contacting said lower end of said print head on said one page;

(l) moving said lower end of said print head in said second direction to said standby position after the completion of print of said second line;

(m) moving said lower end of said print head while keeping it at a height of said standby position along said print direction to a position which is located above first print position of second line of the other page;

(n) moving said lower end of said print head in said first direction from said standby position to said other page;

(o) printing said second line of said the other page by moving said lower end of said print head in said print direction with contacting of said lower end of said print head on the other said page.

8. A method for minimizing the amount of movement of a print head associated with printing on the surfaces of the pages of an open book wherein said movement is in a generally perpendicular relation to said page surfaces of said open book placed upon a planar surface wherein said print head is in an initial position spaced from said page surfaces comprising the steps of:

determining the distance from said initial position to the highest of said page surfaces;

establishing a standby position for said print head which is at a location that is a fraction of the distance from said determining step while permitting shifting of said open book on said planar surface; and returning said print head to said standby position throughout the printing operation by said print head on the said surfaces of the pages of said book for which said determining step was performed.

9. The method in accordance with claim 8 wherein said determining step includes the steps of sensing the distance from said initial position to the surface of each page of said open book to determine the highest thereof over said planar surface.

10. The method in accordance with claim 9 which includes the step of ascertaining the distance from each of said pages of said open book to said standby position for controlling the amount of movement from said standby position to a given page in correlation with the said page on which said print head is intended to print.

* * * * *